US008956110B2

(12) United States Patent
Shioda et al.

(10) Patent No.: US 8,956,110 B2
(45) Date of Patent: Feb. 17, 2015

(54) CENTRIFUGAL COMPRESSOR

(75) Inventors: Jumpei Shioda, Susono (JP); Shinichi Tsuji, Sunto-gun (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 13/992,776

(22) PCT Filed: Dec. 10, 2010

(86) PCT No.: PCT/JP2010/072252

§ 371 (c)(1),
(2), (4) Date: Jun. 10, 2013

(87) PCT Pub. No.: WO2012/077231

PCT Pub. Date: Jun. 14, 2012

(65) Prior Publication Data

US 2013/0272864 A1 Oct. 17, 2013

(51) Int. Cl.

| | |
|---|---|
| ***F04D 29/46*** | (2006.01) |
| ***F04D 29/40*** | (2006.01) |
| ***F04D 29/42*** | (2006.01) |
| ***F04D 29/70*** | (2006.01) |

(52) U.S. Cl.

CPC ..... *F04D 29/403* (2013.01); *F04D 29/4206* (2013.01); *F04D 29/462* (2013.01); *F04D 29/701* (2013.01)

USPC ..... 415/166; 415/211.2

(58) Field of Classification Search

USPC ..... 415/148, 157, 158, 162, 164, 165, 166, 415/208.2, 208.3, 208.4, 211.2

See application file for complete search history.

(56) References Cited

U.S. PATENT DOCUMENTS

| | | | | |
|---|---|---|---|---|
| 5,807,071 | A * | 9/1998 | Brasz et al. | 415/150 |
| 6,155,779 | A | 12/2000 | Watanabe et al. | |
| 2010/0129204 | A1 * | 5/2010 | Higashimori et al. | 415/148 |

FOREIGN PATENT DOCUMENTS

| | | | |
|---|---|---|---|
| CN | 101173683 | A | 5/2008 |
| JP | 5 99199 | | 4/1993 |
| JP | 11 117898 | | 4/1999 |
| JP | 2000 205186 | | 7/2000 |
| JP | 2008 111368 | | 5/2008 |
| JP | 2009 19563 | | 1/2009 |

OTHER PUBLICATIONS

International Search Report Issued Mar. 1, 2011 in PCT/JP10/72252 Filed Dec. 10, 2010.

* cited by examiner

*Primary Examiner* — Richard Edgar

(74) *Attorney, Agent, or Firm* — Oblon, Spivak, McClelland, Maier & Neustadt, L.L.P.

(57) ABSTRACT

A compressor includes plural first vanes provided on a shroud side of a diffuser path, and plural second vanes provided on positions of a hub side opposed to the first vanes. The compressor also includes a slide vane mechanism that projects the second vanes into and draws in the second vanes from the diffuser path via the slits of the hub side wall part plate according to a load of the compressor. When the slide vane mechanism projects the second vanes into the diffuser path, end faces of the first vanes and end faces of the second vanes are opposed to each other at the vicinity of the center of the diffuser path.

2 Claims, 14 Drawing Sheets

DISTRIBUTION OF FLOW VELOCITY
OF HUB WALL SIDE

DISTRIBUTION OF FLOW VELOCITY
OF SHROUD WALL SIDE

CENTRIFUGAL COMPRESSOR

TECHNICAL FIELD

The present invention is related to a centrifugal compressor.

BACKGROUND ART

Conventionally, there has been known a centrifugal compressor that is provided between an impeller and a scroll, and provides diffuser vanes which carry out slowdown pressurization of the fluid speeded up by the impeller, on a diffuser path. As the modification of such a centrifugal compressor, there is a suggestion in which the vanes are provided on both of a hub side wall surface and a shroud side wall surface composing the diffuser path, and vanes provided on the shroud side wall surface are rotated coaxially with a rotating shaft of the impeller (See Patent Document 1). This suggestion changes a relative position relationship between the vanes provided on the hub side wall surface and the vanes provided on the shroud side wall surface in order to improve the efficiency of the centrifugal compressor.

PRIOR ART DOCUMENT

Patent Document

[Patent Document 1] Japanese Patent Application Publication No. 2008-111368

SUMMARY OF THE INVENTION

Problems to be Solved by the Invention

And now, in the suggestion of Patent Document 1, a clearance needs to be formed for each portion in order to rotate the vanes provided on the shroud side wall surface coaxially with the rotating shaft of the impeller. Forming the appropriate clearance for each portion is needed in order to reduce friction at the time of the rotation of the vanes and also realize smooth operation. For example, clearances are formed between the vanes provided on the shroud side wall surface, and the hub side wall surface. Similarly, clearances are also formed between the vanes provided on the hub side wall surface, and the shroud side wall surface.

However, in the suggestion of Patent Document 1, the positions at which the clearances are formed are the vicinity of the hub side wall surface and the shroud side wall surface. That is, the positions at which the clearances are formed are portions where the velocity of the fluid in the diffuser path is comparatively low. Therefore, it is easy to accumulate deposit on the portions at which such clearances have been formed. When the deposit accumulates on the portions at which the clearances have been formed, it is considered that an influence attains to operation of the diffuser vanes.

The present invention has been made in consideration of the above situation, and its object is to provide a centrifugal compressor that secures smooth operation of vanes in the centrifugal compressor by reducing the accumulation of deposit.

Means for Solving the Problems

To solve the above problem, a centrifugal compressor of the present invention includes: a diffuser path that converts kinetic energy of a fluid which an impeller discharges into a pressure, the impeller rotating in a housing of the compressor; a shroud side wall part that forms the diffuser path; a hub side wall part that is opposed to the shroud side wall part, and forms the diffuser path along with the shroud side wall part; a first guide vane that is provided on the shroud side wall part, and projects into the diffuser path toward the hub side wall part; a second guide vane that is provided on a position on the hub side wall part opposed to the first guide vane, and projects into the diffuser path toward the first guide vane; and a changeable portion capable of changing a relative position between the first guide vane and the second guide vane; wherein an end face of the first guide vane and an end face of the second guide vane are opposed to each other in the diffuser path, the changeable portion is a rotation portion that rotates at least one of the first guide vane and the second guide vane in a circumferential direction of the impeller, and the changeable portion changes the relative position between the first guide vane and the second guide vane according to a pressure of the fluid which flows through the compressor.

With the above-mentioned configuration, a position of a clearance between the end of the first guide vane and the end of the second guide vane becomes the vicinity of the center of the diffuser path (i.e., the vicinity of half of a width of the diffuser path). That is, the position (i.e., the positions of the ends of the vanes) at which the clearance is provided is a place where the velocity of the fluid in the diffuser path is relatively high. Therefore, the accumulation of deposit to the clearance (i.e., the ends of the vanes) can be reduced.

With the above-mentioned configuration, a relative position between the first guide vane and the second guide vane is changed, so that the size of the clearance between the end of the first guide vane and the end of the second guide vane can be changed. Therefore, the accumulation of deposit to the ends of the vanes can be reduced more effectively.

Moreover, with the above-mentioned configuration, the accumulation of deposit to the ends of the first guide vane and the second guide vane is reduced, and the deposit on the clearance can be scraped off by a shearing force when at least one of the guide vanes is rotated. Therefore, the accumulation of deposit to the ends of the vanes can be reduced more effectively.

Then, in the centrifugal compressor of the present invention, the first guide vane and the second guide vane may have parts in which amounts of projection into the diffuser path are different, respectively, a sum of a maximum amount of projection of the first guide vane and a maximum amount of projection of the second guide vane may be equal to or more than a width of the diffuser path, and the end face of the first guide vane and the end face of the second guide vane may have forms which engage with each other.

With the above-mentioned configuration, the end face of the first guide vane and the end face of the second guide vane can be engaged with each other. Thereby, the accumulation of deposit to the ends of the vanes can be reduced. Further, the leak of the air from the clearance can be reduced, and the efficiency of the compressor can be improved.

Effects of the Invention

According to the centrifugal compressor described herein, it is possible to reduce the accumulation of deposit and secure smooth operation of vanes in the centrifugal compressor.

MODES FOR CARRYING OUT THE INVENTION

Hereinafter, a description will be given of an embodiment of the present invention with reference to the drawings.

First Embodiment

Figure 1:
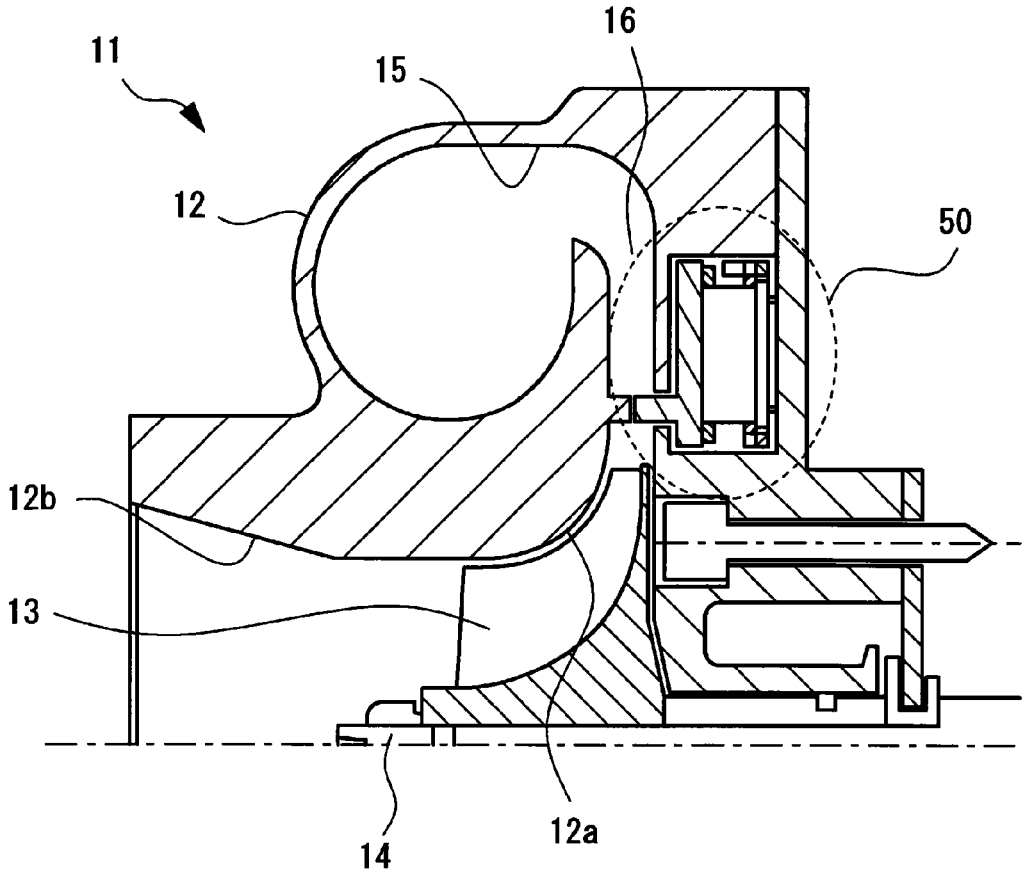
FIG. 1 is a schematic diagram of a compressor according to a first embodiment.

An embodiment of the present invention is described with reference to the drawings. FIG. 1 is a schematic diagram of a compressor (a centrifugal compressor) 11 according to a first embodiment. A compressor housing 12 constitutes a housing of the compressor 11. The compressor housing 12 includes an impeller housing part 12*a*. An impeller 13 is housed in the impeller housing part 12*a*. The impeller 13 is rotated by a shaft 14. The shaft 14 can be coupled with a turbine, for example. That is, the compressor can be used for a turbocharger, for example.

Fluid is sucked into the compressor housing 12 from a suction port 12*b*. The sucked fluid flows toward the impeller 13, and is discharged towards the outside by the rotation of the impeller 13. A scroll part 15 is provided in the outside of the impeller 13. The fluid discharged towards the outside by the impeller 13 is supplied to an intake manifold of an engine or the like via the scroll part 15, for example. A diffuser part 16 having a diffuser path is provided between the impeller 13 and the scroll part 15. The diffuser part 16 is provided so as to adjoin around the impeller 13. The diffuser part 16 converts kinetic energy of the fluid which the impeller 13 discharges into a pressure.

Figure 2:
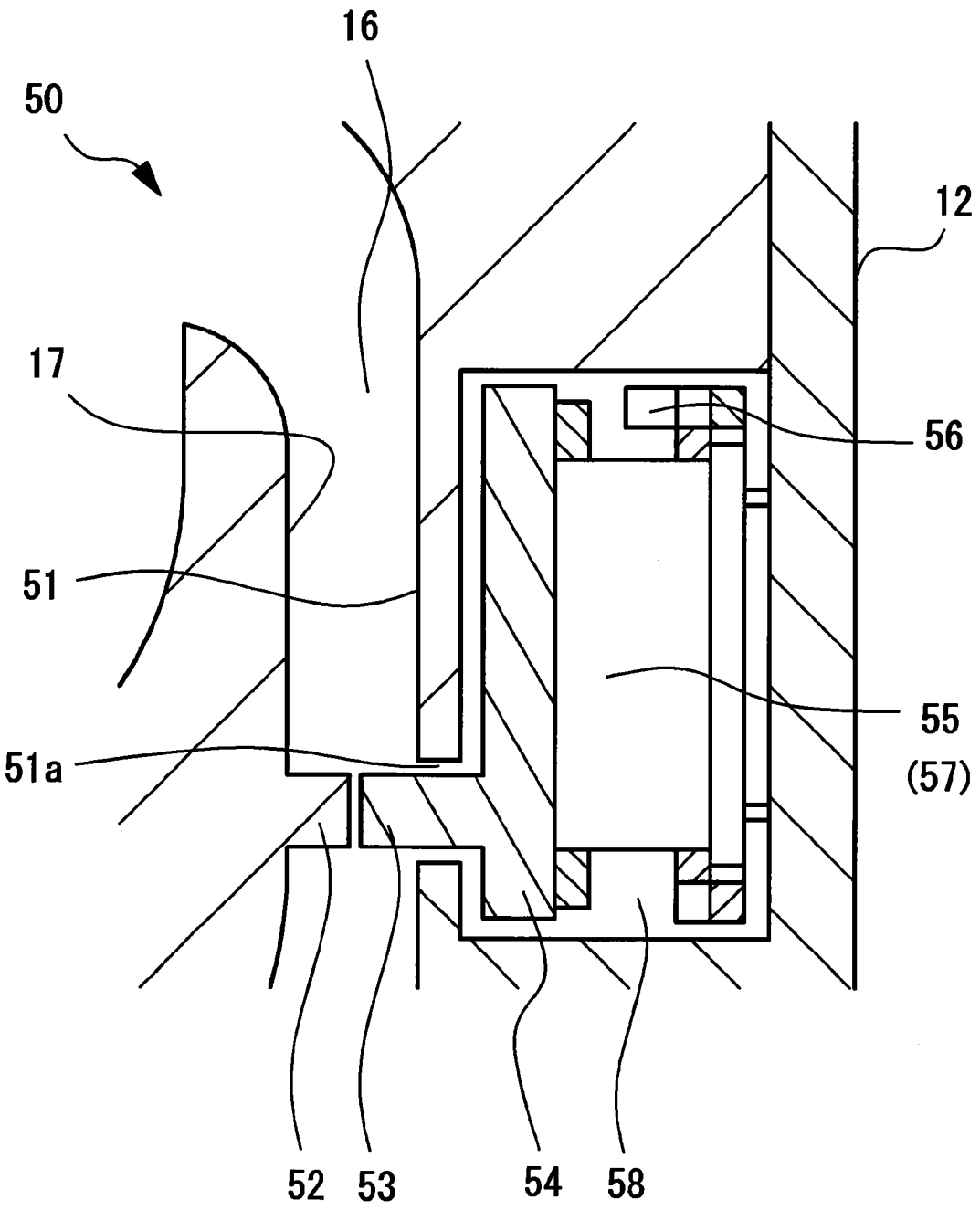
FIG. 2 is a cross-section diagram illustrating a substantial part of a diffuser part.

A detailed description is given of the diffuser part 16 with the use of FIG. 2. FIG. 2 is a cross-section diagram illustrating a substantial part of the diffuser part 16. FIG. 2 illustrates a cross-section surface along a width direction of first vanes 52 and second vanes 53. The diffuser part 16 includes a hub side wall part plate 51, first vanes 52, second vanes 53 integrated with a diffuser plate 54, a cam ring 55, a drive rod 56, and a spring 57.

As illustrated in FIG. 2, the compressor 11 includes fixed first vanes 52 and movable second vanes 53. The first vanes 52 are guide vanes provided on the shroud side wall part 17, and are provided so as to form an annular line to the diffuser path. The first vanes 52 are arranged so that the longitudinal directions of the vanes are inclined at predetermined angles with respect to a direction of the shaft 14 of the impeller 13. In this case, the first vanes may provide pivot shafts on portions fixed with the shroud side wall part 17, so that the angles of the vanes can be changed. Then, each end face of the first vanes 52 projects to a substantial center of a width of the diffuser path. It should be noted that each first vane 52 is an example of the configuration of a first guide vane of the present invention.

The second vanes 53 are guide vanes provided on the side of the hub side wall part plate 51, and are provided at positions opposed to the first vanes 52 (for every first vanes 52), respectively. The second vanes 53 can project into the diffuser path through the slits 51*a* of the hub side wall part plate 51. In order that each end face of the second vanes 53 is opposed to each end face of the first vanes 52, the second vanes 53 are arranged so that the longitudinal directions of the vanes are inclined at predetermined angles with respect to the direction of the shaft 14 of the impeller 13. In this case, the second vanes 53 may employ pivot mechanisms, so that the angles of the vanes can be changed. It should be noted that each second vane 53 is an example of the configuration of a second guide vane of the present invention.

The second vane 53 is incorporated in a slide vane mechanism 50. The slide vane mechanism 50 is attached to the compressor housing 12 from a rear side of the impeller 13. The slide vane mechanism 50 makes the second vanes 53 movable. A description will be given of the slide vane mechanism 50, with reference to FIGS. 3, 4A and 4B.

Figure 3:
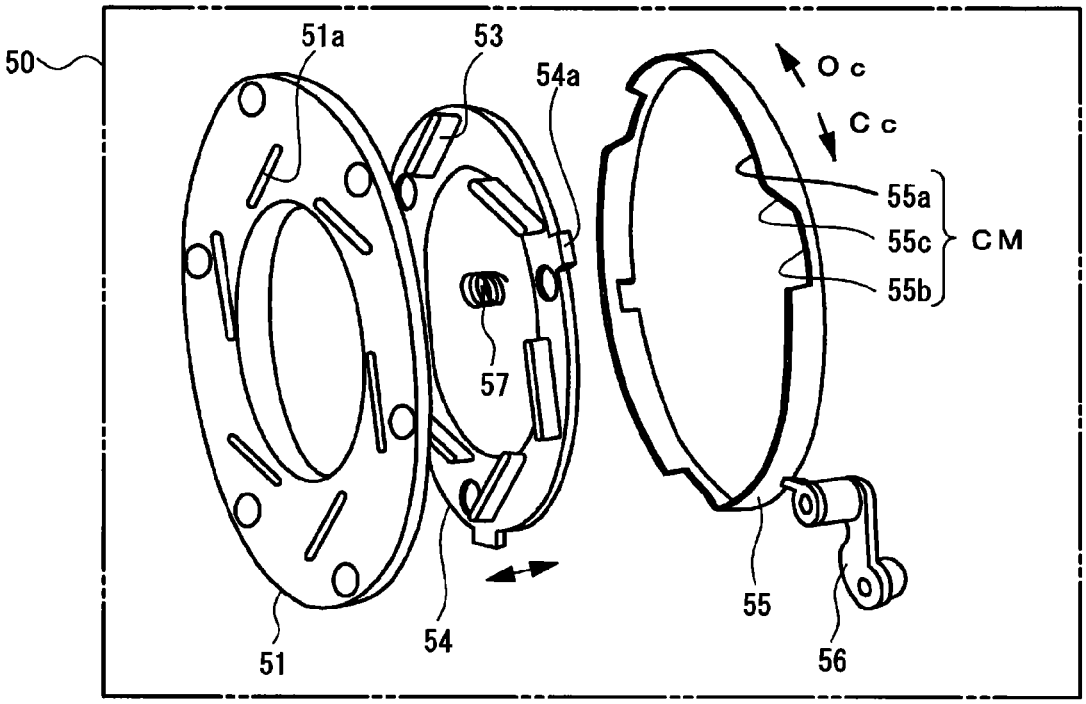
FIG. 3 is a diagram illustrating disassembly configuration of a slide vane mechanism.
Figure 4A:
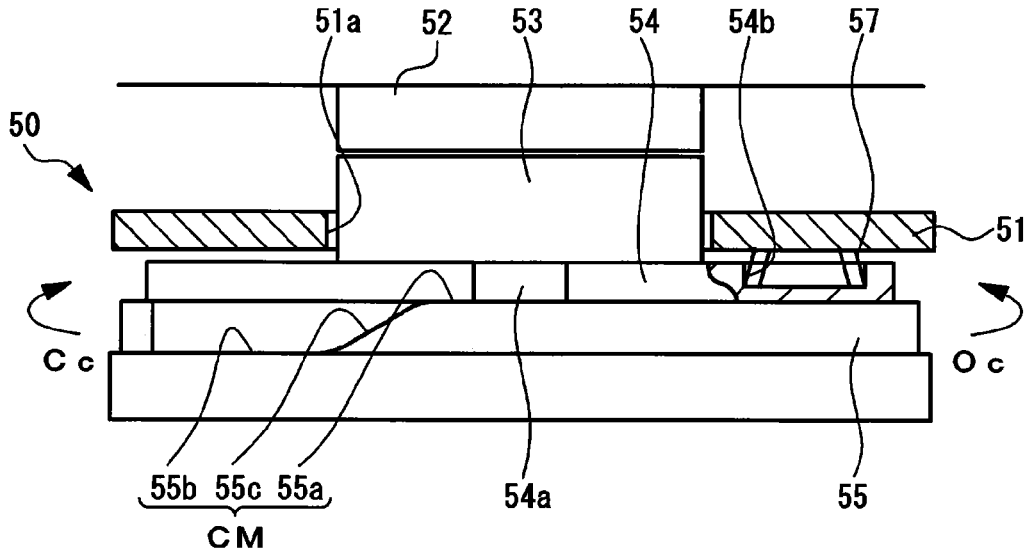
FIG. 4A is a schematic cross-section diagram of the slide vane mechanism and, illustrates a state where second vanes have projected into a diffuser path.
Figure 4B:
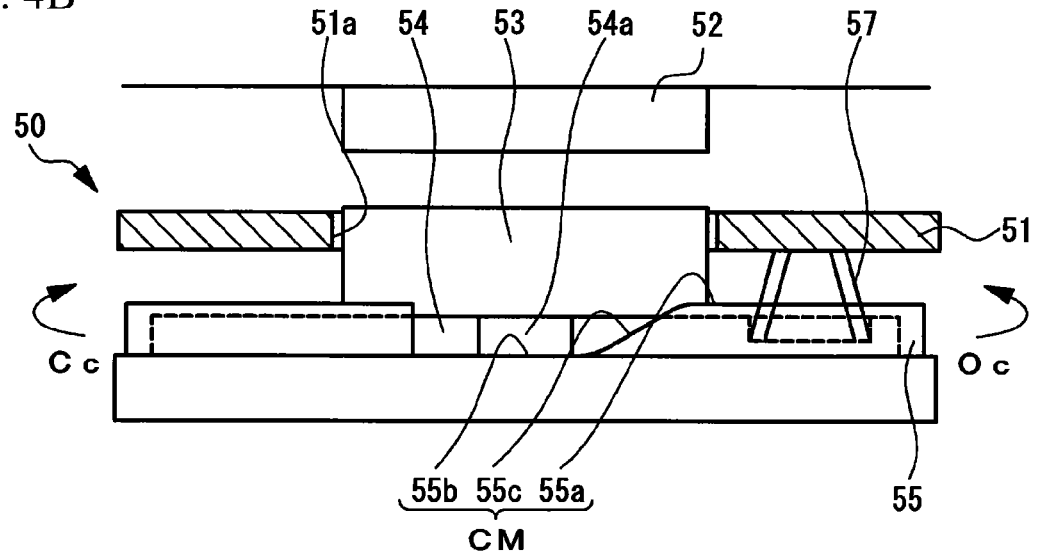
FIG. 4B is a schematic cross-section diagram of the slide vane mechanism and, illustrates a state where the second vanes have been drawn into slits.

FIG. 3 is a diagram illustrating disassembly configuration of a slide vane mechanism 50. FIGS. 4A and 4B are schematic cross-section diagrams of the slide vane mechanism 50. FIGS. 4A and 4B illustrate the compressor housing 12 and the slide vane mechanism 50. FIG. 4A illustrates a state where the second vanes 53 have projected into the diffuser path, and FIG. 4B illustrates a state where the second vanes 53 have been drawn into slits 51*a* described later.

When a side illustrated in FIG. 3 is a right face side, the slide vane mechanism 50 is attached to the compressor housing 12 according to a direction in which the right face side is united with a side of the compressor 11. The slide vane mechanism 50 includes the hub side wall part plate 51, the diffuser plate 54, the cam ring 55, the drive rod 56, the spring 57, and a housing part 58 in addition to the second vanes 53.

The hub side wall part plate 51 is a path wall part which forms the diffuser path along with the shroud side wall part 17 of the compressor housing 12. The hub side wall part plate 51 has slits 51*a*. The slits 51*a* are through holes having similar shapes to the second vanes 53. The slits 51*a* are provided at positions opposed to the first vanes 52 for every second vanes 53, and enable the second vanes 53 to project into the diffuser path. It should be noted that each slit 51*a* is an example of the configuration of a second through hole of the present invention.

The diffuser plate 54 is provided behind the hub side wall part plate 51. The diffuser plate 54 is an annular component, and the second vanes 53 are provided on the diffuser plate 54. The second vanes 53 are provided so as to form an annular line on the right face side of the diffuser plate 54. Although in the present embodiment, the second vanes 53 are integrally formed with the diffuser plate 54, the second vanes 53 may employ pivot mechanisms, so that the angles of the second vanes 53 can be changed. The diffuser plate 54 is provided so as to be able to move along a shaft direction of the compressor 11. The diffuser plate 54 moves along the shaft direction of the compressor 11, so that the second vanes 53 are projected into or drawn in from the diffuser path.

The cam ring 55 is provided behind the diffuser plate 54. The cam ring 55 is a cylindrical component, and is rotatably provided around the shaft of the compressor 11 (the impeller 13). The cam ring 55 includes protrusion parts 55*a*, retraction parts 55*b*, and connection parts 55*c*. The protrusion parts 55*a*, the retraction parts 55*b*, and the connection parts 55*c* are provided at the right face side of the cam ring 55.

The plurality of protrusion parts 55*a* (three protrusion parts 55*a* in the present embodiment) are evenly provided along a circumferential direction. The protrusion parts 55*a* are mutually formed flatly with the same height from a bottom by setting a circular end of the rear side of the cam ring 55 as the bottom. Each retraction part 55*b* is provided between the adjacent protrusion parts 55*a*. The retraction parts 55*b* are also mutually formed flatly with the same height from the bottom. The protrusion parts 55*a* are projected to the right face side, compared with the retraction parts 55*b*.

Each protrusion part 55*a* is connected between the retraction parts 55*b* located in the same direction among the adjacent retraction parts 55*b*, via the connection parts 55*c*. The connection parts 55*c* are inclined so as to rise aslant toward the protrusion parts 55*a* from the retraction parts 55*b*. The connection parts 55*c* have smooth junction curves and are joined with the protrusion parts 55*a* and the retraction parts 55*b*. The protrusion parts 55*a*, the retraction parts 55*b*, and the connection parts 55*c* constitute cams CM.

Each cam CM engages with a cam engaging part 54*a*. The cam engaging part 54*a* is provided on the diffuser plate 54 for each cam CM. The cam engaging part 54*a* is provided so as to project with a block shape from the outer circumference of the diffuser plate 54. A position of the cam engaging part 54*a* taken along a radial direction is set to an engageable position with the cam CM. The width of the cam engaging part 54*a* taken along a circumferential direction is set smaller than the width of each retraction part 55*b* taken along a circumferential direction.

The above-mentioned cam mechanism operates according to a rotational direction of the cam ring 55, as described later. That is, when the cam ring 55 rotates in an arrow Cc direction, the cam mechanism operates so as to project the second vanes 53 into the diffuser path. Also, when the cam ring 55 rotates in an arrow Oc direction, the cam mechanism operates so as to bury (draw) the second vanes 53 into the slits 51*a*. By this means, the cam mechanism projects or draws the second vanes 53 into/from the diffuser path.

The drive rod 56 is provided on the cam ring 55. The drive rod 56 is connected to an actuator, not shown, and enables the drive of the cam ring 55 from the outside. Therefore, the cam ring 55 is rotated by a drive input through the drive rod 56.

The spring 57 is a metal elastic component and is provided between the hub side wall part plate 51 and the diffuser plate 54. The spring 57 biases the diffuser plate 54 to a side of the cam ring 55. Thereby, the unnecessary movement of the diffuser plate 54 is limited. The spring 57 can be provided as described later. That is, a plurality of housing parts 54*b* (for example, three housing parts) which can store plural springs 57 are evenly provided along a circumferential direction in the right face side of the diffuser plate 54. Then, the spring 57 is provided on each housing part 54*b*. The housing part 54*b* can be formed in a closed-bottom cylindrical form. In this case, the spring 57 is not limited to the metal elastic component, and may be another component that can bias the diffuser plate 54 to the side of the cam ring 55.

The housing part 58 is a hollow room formed with the compressor housing 12 and the hub side wall part plate 51. The housing part 58 has an enough space that can house the whole second vanes 53, and houses the second vanes 53 to be buried (drawn) into the slits 51*a* according to the operation of the cam mechanism.

By the above-mentioned slide vane mechanism 50, each end face of the second vanes 53 is projected to the substantial center of the width of the diffuser path and to a position in which each end face of the second vanes 53 does not contact each end face of the opposed first vanes 52. That is, each second vane 53 is projected to a position away from a corresponding end face of the opposed first vanes 52 by a given clearance. Thereby, the first vanes 52 and the second vanes 53 are projected into the diffuser path, so that the compression efficiency of the compressor 11 can be improved. Moreover, the position at which the clearance between each first vane 52 and each second vane 53 is provided can be set in the vicinity of the center of the diffuser path (in the vicinity of the half of the width of the diffuser path).

Further, by the above-mentioned slide vane mechanism 50, the second vanes 53 are buried (drawn) into the slits 51*a*. Thereby, the clearance between each first vane 52 and each second vane 53 can be enlarged, and hence collision loss of the air to the first vanes 52 and the second vanes 53 can be reduced. Moreover, the wall surface of the diffuser path at the side in which the second vanes 53 are drawn becomes vaneless, and is in a state where a definite throat is not formed.

Figure 5A:
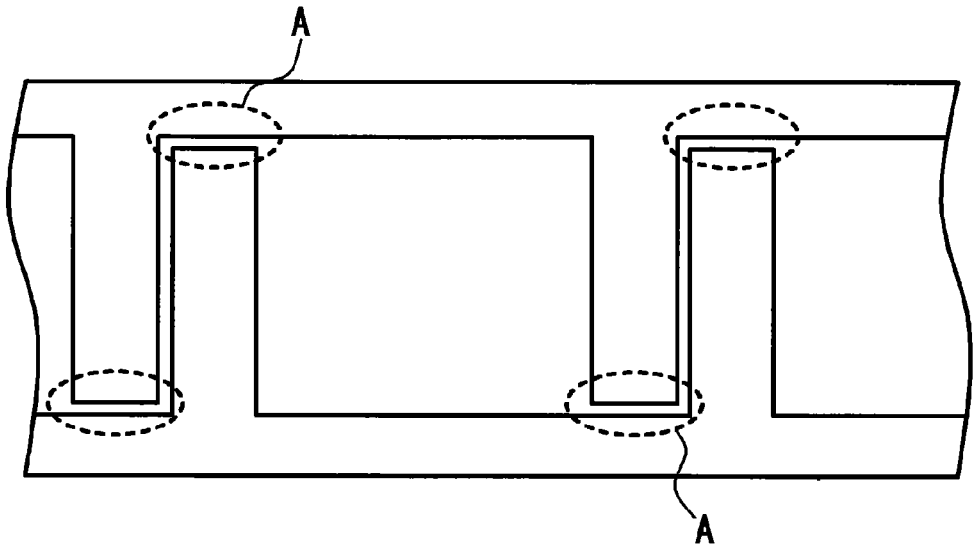
FIG. 5A is an explanatory diagram schematically illustrating the arrangement of the vanes when a compressor according to a comparative example is in a low load range.
Figure 5B:
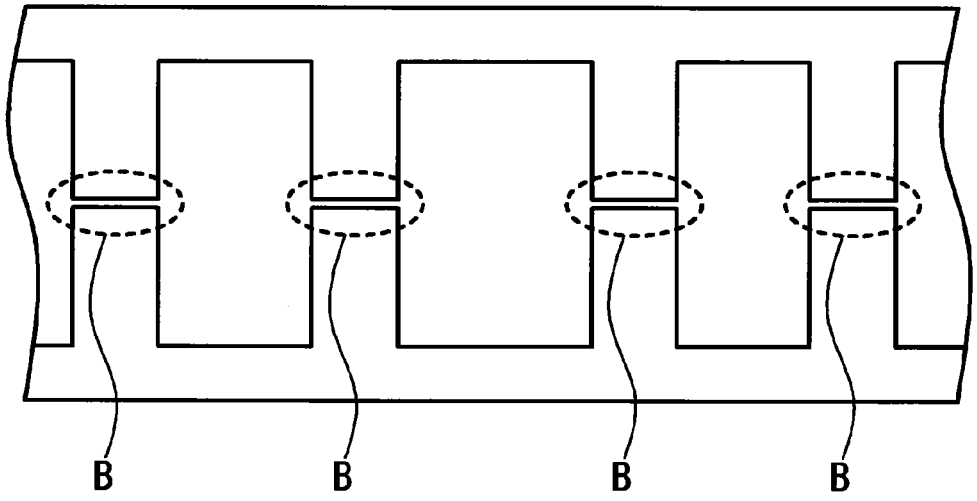
FIG. 5B is an explanatory diagram schematically illustrating the arrangement of the vanes when the compressor according to the embodiment is in the low load range.

FIG. 5A is an explanatory diagram schematically illustrating the arrangement of the vanes when the compressor according to the comparative example is in a low load range. FIG. 5B is an explanatory diagram schematically illustrating the arrangement of the vanes when the compressor 11 according to the embodiment is in the low load range. In general, when fluid flows through a certain path, a resistance occurs between the flowing fluid and a path wall. Therefore, the velocity of the fluid which flows through the central side of the path becomes comparatively high, and the speed of the fluid becomes low as the fluid approaches the path wall side. That is, the velocity of the fluid (air) at the wall side becomes lower than that of the fluid in the vicinity of the center of the diffuser path of the compressor (i.e., the vicinity of the half of the width of the diffuser path). Therefore, the ends of the vanes are provided at the wall sides of the diffuser path (see A in FIG. 5A), so that it becomes easy to accumulate a deposit on the ends of the vanes.

Here, the compressor 11 according to the present embodiment can set the ends of the first vanes 52 and the second vanes 53 to the vicinity of the center of the diffuser path (i.e., the vicinity of the half of the width of the diffuser path) in which the velocity of the air is comparatively high (see B in FIG. 5B). Therefore, the accumulation of the deposit to the ends of the vanes can be reduced, so that smooth operation of the vanes in the centrifugal compressor can be secured.

In this case, as a form in which the end faces of the first vanes 52 engage with (or fit together with) the end faces of the second vanes 53, the end faces of the second vanes 53 may be projected to the positions where they come in contact with the end faces of the opposed first vanes 52, by the use of the slide vane mechanism 50. According to the construction, the clearances between the first vanes 52 and the second vanes 53 can be vanished at the time of the projection of the second vanes 53, and hence the accumulation of the deposit to the ends of the vanes can be reduced. In addition, the leak of the air from the clearances can be reduced, and the efficiency of the compressor can be improved.

Figure 6A:
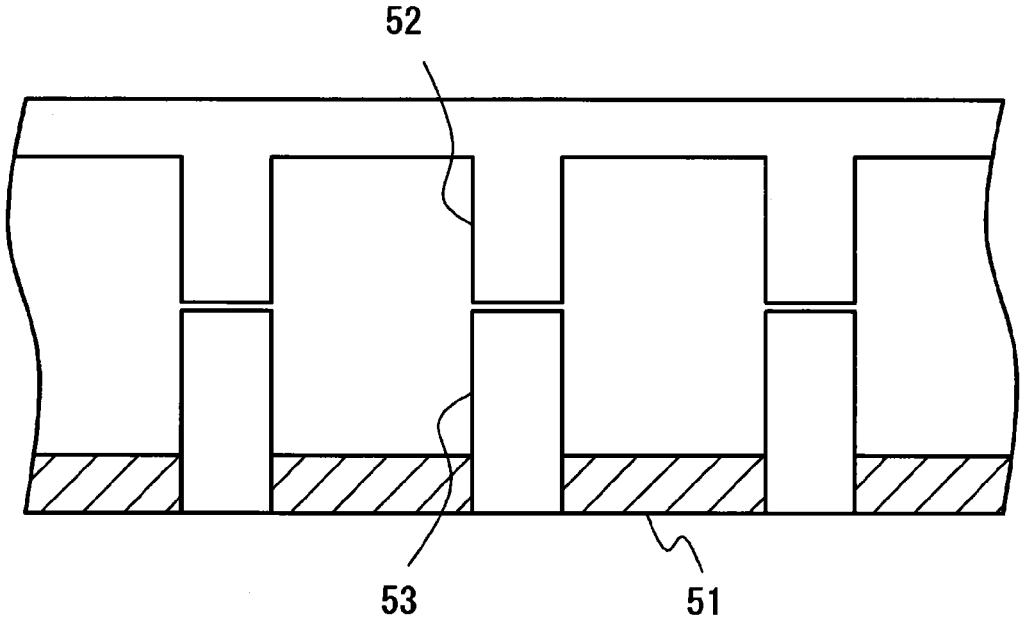
FIG. 6A is an explanatory diagram schematically illustrating the arrangement of the vanes when the compressor according to the first embodiment is in the low load range.
Figure 6B:
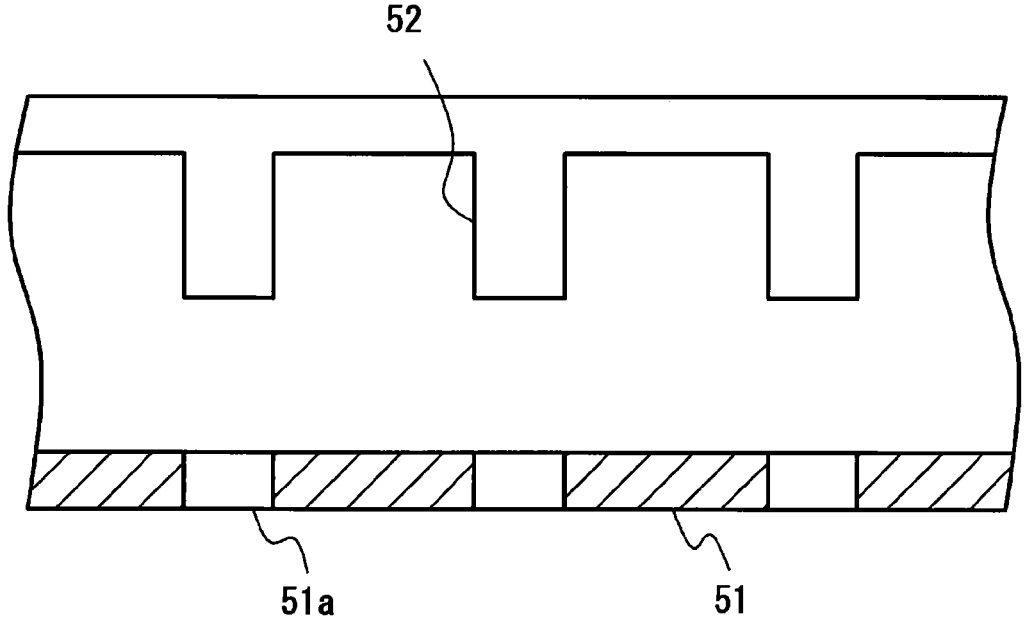
FIG. 6B is an explanatory diagram schematically illustrating the arrangement of the vanes when the compressor according to the first embodiment is in a high load range.

Next, a description will be given of operation control of the slide vane mechanism 50 according to the present embodiment. FIG. 6A is an explanatory diagram schematically illustrating the arrangement of the vanes when the compressor 11 according to the first embodiment is in the low load range. FIG. 6B is an explanatory diagram schematically illustrating the arrangement of the vanes when the compressor 11 according to the first embodiment is in a high load range. An ECU (Electronic Control Unit) provided outside controls the actuator, for example, so that the operation control of the slide vane mechanism 50 is performed. When an operating range of the compressor 11 according to the first embodiment is relatively the low load, i.e., a volume of the air which flows through the compressor 11 is less than a given value, the actuator rotates the cam ring 55 in an arrow direction Cc of FIGS. 4A and 4B. Thereby, the second vanes are projected into the diffuser path (see FIG. 6A), so that the compression efficiency of the compressor 11 in the low load range can be improved. Here, the given value of the volume of the air is a threshold of the volume of the air in which the compression efficiency at time when the second vanes 53 are projected becomes higher than the compression efficiency at time when the second vanes 53 are buried into the diffuser path, and an arbitrary pressure value calculated beforehand by the engine bench test can be applied as the given value of the volume of the air. Also, the volume of the air which flows through the compressor 11 may be detected directly by providing a pressure sensor, an airflow meter, and the like, or may be detected indirectly from the number of rotations of the impeller 13 or the like.

On the other hand, when the operating range of the compressor 11 is relatively the high load, i.e., the volume of the air which flows through the compressor 11 is equal to or more than the given value, the actuator rotates the cam ring 55 in an arrow direction Oc of FIGS. 4A and 4B. Thereby, the second vanes 53 are buried (drawn) into the slits 51*a* (see FIG. 6B), and collision loss of the air to the first vanes 52 and the second vanes 53 is reduced. That is, stable operation in the high load range of the compressor 11 can be achieved. Moreover, the second vanes 53 are projected into the diffuser path, so that the clearances (i.e., the ends of the vanes) between the first vanes 52 and the second vanes 53 can be located at the vicinity of the center of the diffuser path where the velocity of the fluid is relatively high. Thereby, the accumulation of the deposit to the ends of the vanes can be reduced.

It should be noted that the slide vane mechanism 50 is an example of the configuration of a projection and drawing portion (a changeable portion) of the present invention.

Figure 7A:
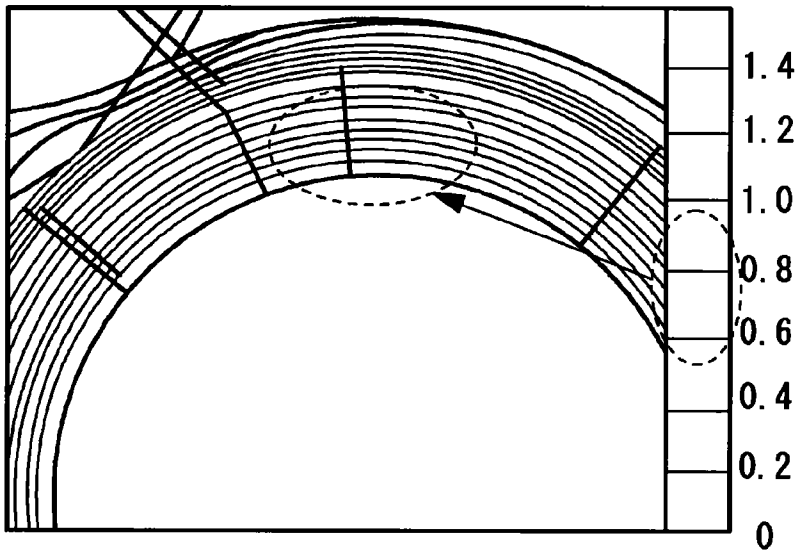
FIG. 7A is a graph illustrating a distribution of a flow velocity of a hub side.
Figure 7B:
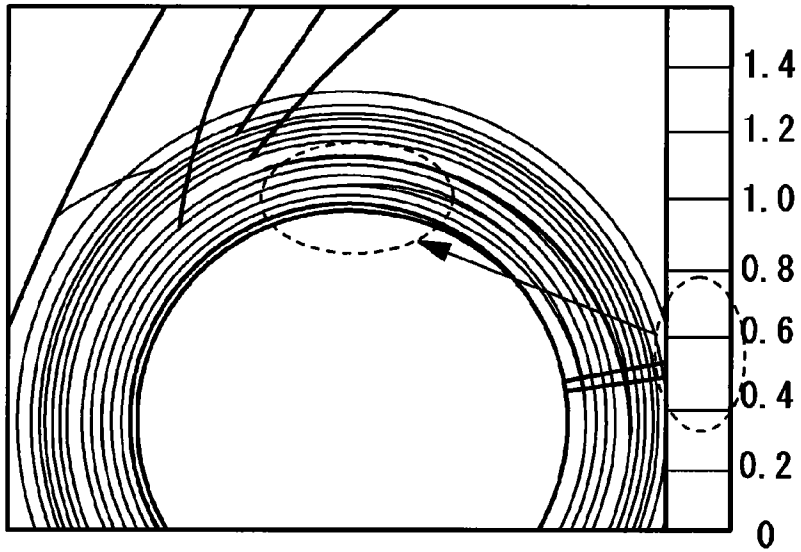
FIG. 7B is a graph illustrating a distribution of a flow velocity of a shroud side.

FIG. 7A is a graph illustrating a distribution of a flow velocity of a hub side, and FIG. 7B is a graph illustrating a distribution of a flow velocity of a shroud side. In the diffuser path of the compressor 11, the velocity of the air which flows through the vicinity of the hub side wall part plate 51 (see FIG. 7A) is relatively higher than the velocity of the air which flows through the vicinity of the shroud side wall part 17 (see FIG. 7B). Therefore, in the high load range of the compressor 11, the second vanes provided at the hub side are buried (drawn), so that the collision loss of the air to each vane can be further reduced.

Figure 8:
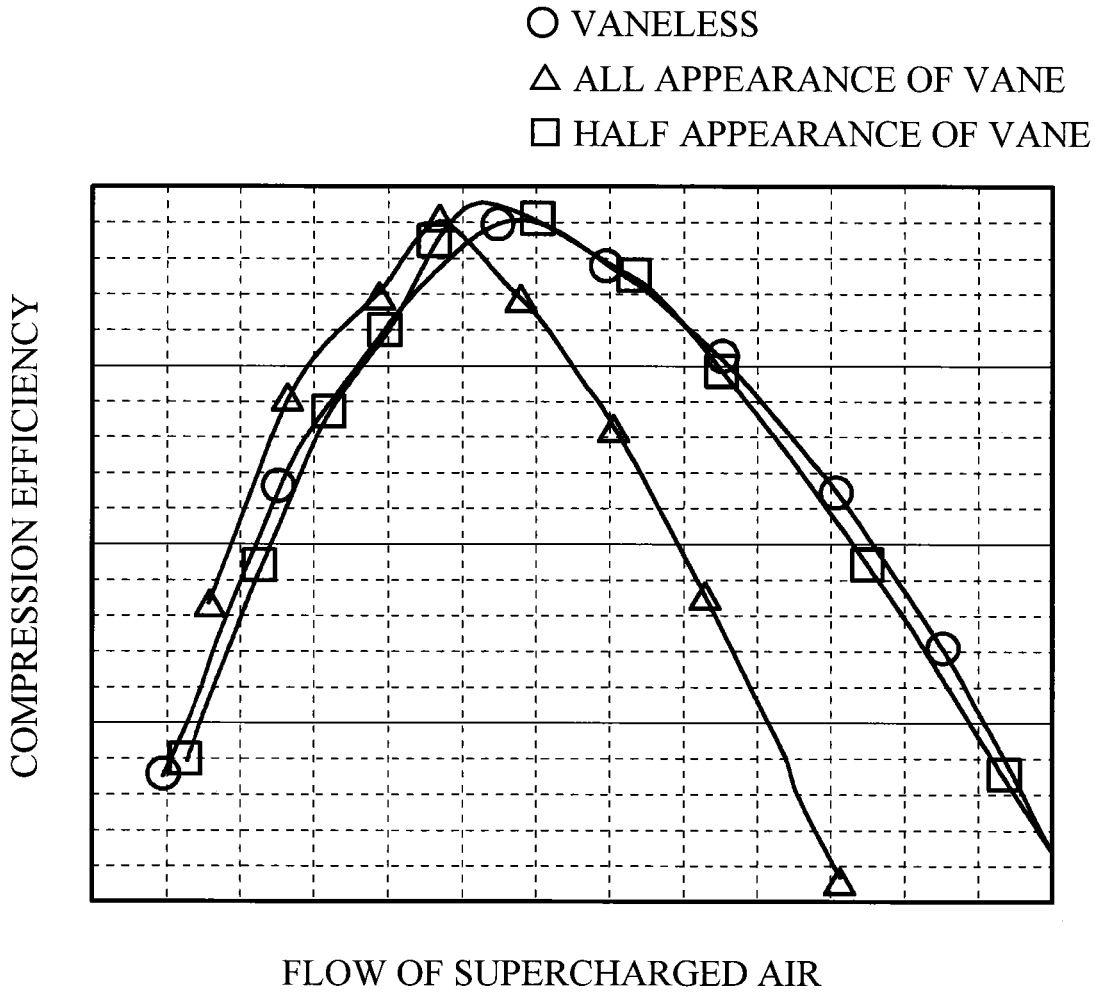
FIG. 8 is a graph illustrating differences of compression efficiency of the compressor and a flow of supercharged air depending on differences of projection states of the vanes.

FIG. 8 is a graph illustrating differences of compression efficiency of the compressor and a flow of supercharged air depending on differences of projection states of the vanes. When the vanes are projected to a limit of the width of the diffuser path (all appearance of vanes) as illustrated in FIG. 8, the compression efficiency of the compressor reduces as the flow of the supercharged air increases. When the vanes are not projected (vaneless) and the vanes are projected to a half of the width of the diffuser path (half appearance of vanes), the almost same compression efficiency of the compressor is obtained irrespective of the flow of the supercharged air. Therefore, when the vanes are provided on the shroud side and the hub side of the diffuser path, if any one of the vanes can be projected and drawn, the almost same compression efficiency as that of the case where both of the vanes can be projected and drawn can be obtained. Accordingly, when the first vanes 52 to be provided on the shroud side wall part 17 are fixed, and the second vanes to be provided on the hub side can be projected and drawn, high compression efficiency can be obtained in all load range of the compressor 11.

As described above, in the compressor according to the present embodiment, the end faces of the first vanes provided at the shroud side of the diffuser path and the end faces of the second vanes provided at the hub side are opposed to each other at the vicinity of the center of the diffuser path, so that the ends of the vanes can be provided at a position where the velocity of the fluid in the diffuser path is relatively high. Therefore, the accumulation of the deposit to the ends of the vanes can be reduced, and hence smooth operation of the vanes in the centrifugal compressor can be secured.

In addition, the compressor according to the present embodiment is configured such that the second vanes can be projected into and drawn in from the diffuser path through the slits of the hub side wall part plate, and hence the sizes of the clearances between the first vanes and the second vanes can be changed. Therefore, the accumulation of the deposit to the ends of the vanes can be reduced more effectively. In addition, the second vanes are projected into and drawn in from the diffuser path according to the load of the compressor, so that high compression efficiency can be obtained in all load range of the compressor.

Second Embodiment

Next, a description will be given of a second embodiment of the present invention. A compressor 111 according to the second embodiment differs from the first embodiment in that a diffuser plate 154 including a plurality of second vanes 153 has a rotary vane mechanism 150 which can rotate coaxially with the rotating shaft of the impeller 13 at the hub side.

Figure 9:
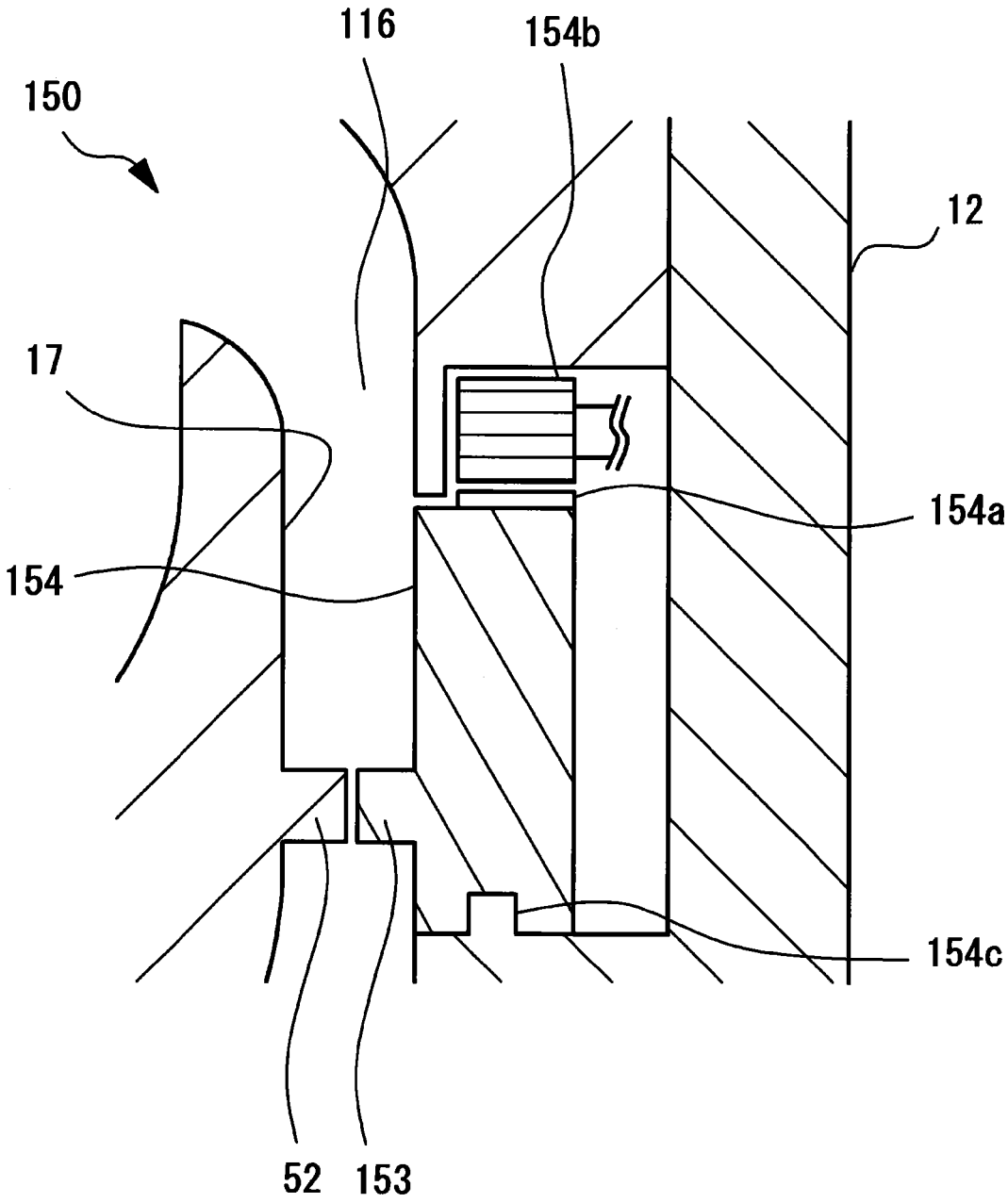
FIG. 9 is a cross-section diagram illustrating the substantial part of the diffuser part according to a second embodiment.

FIG. 9 is a cross-section diagram illustrating the substantial part of a diffuser part 116 according to the second embodiment. FIG. 9 illustrates a cross-section surface taken along a width direction of the second vanes 153. The rotary vane mechanism 150 according to the present embodiment has the same configuration as the slide vane mechanism 50 according to the first embodiment except that the diffuser plate 154 including the second vanes 153 can rotationally move (rotate) coaxially with the rotating shaft of the impeller 13. It should be noted that corresponding component elements to those in the first embodiment are designated by the same numerals in drawings.

Figure 10B:
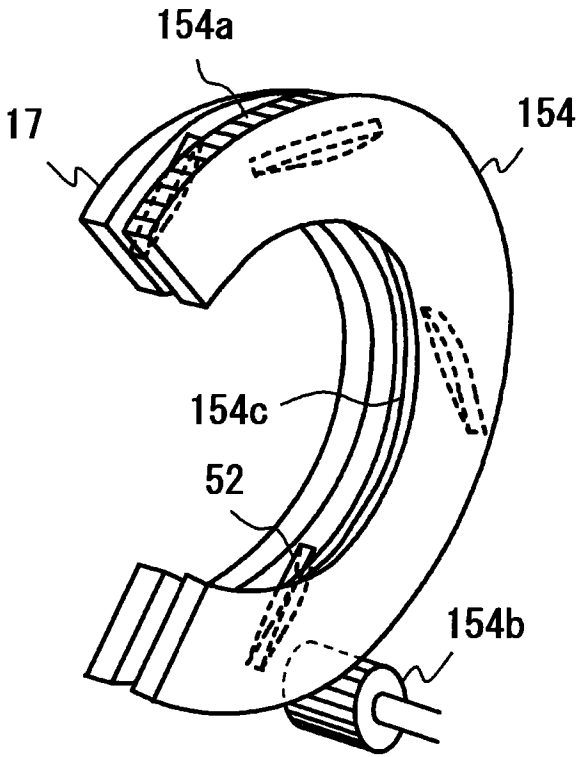
FIGS. 10A and 10B are schematic diagrams of a rotary vane mechanism according to the second embodiment.
Figure 10A:
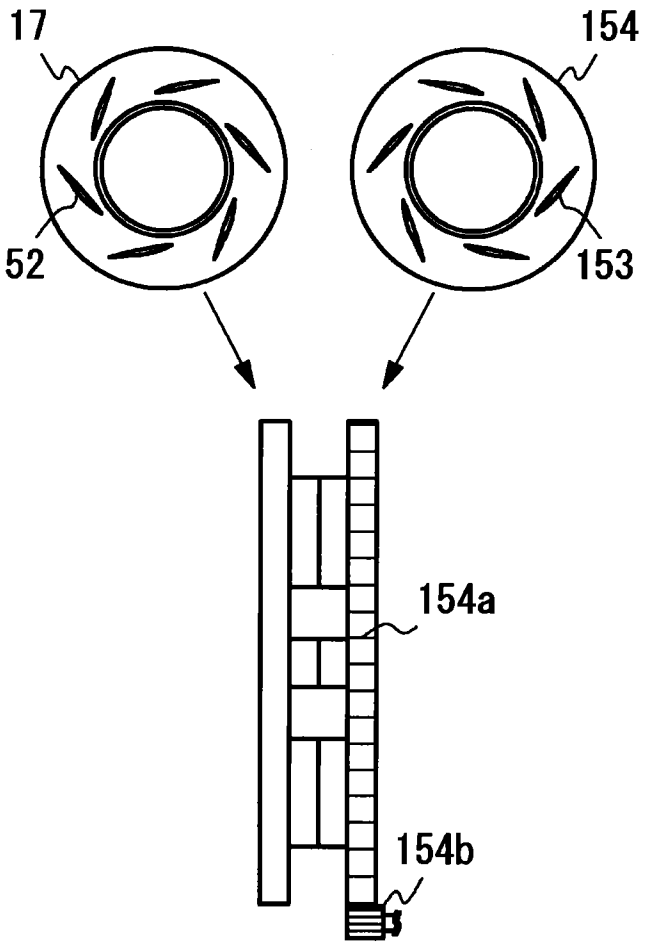

FIGS. 10A and 10B are schematic diagrams of the rotary vane mechanism 150 according to the second embodiment. FIG. 10A illustrates a front view, and FIG. 10B illustrates a perspective view. The rotary vane mechanism 150 includes: the diffuser plate 154 having a rack gear part 154*a* and a guide rail part 154*c*; the second vanes 153 integrated with the diffuser plate 154; and a pinion gear 154*b*.

The second vanes 153 are guide vanes provided on the hub side of the diffuser plate 154, and are provided at positions opposed to the first vanes 52 (for every first vanes 52), respectively. The second vanes 153 can rotate coaxially with the rotating shaft of the impeller 13 along with the rotational drive of the diffuser plate 154. In order that each end face of the second vanes 153 is opposed to each end face of the first vanes 52, the second vanes 153 are arranged so that the longitudinal directions of the vanes are inclined at predetermined angles with respect to the direction of the shaft 14 of the impeller 13. In this case, the second vanes 153 may employ pivot mechanisms, so that the angles of the vanes can be changed. Then, each end face of the second vanes 153 projects to a substantial center of the width of the diffuser path. That is, each second vane 153 is projected to a position away from a corresponding end face of the opposed first vanes 52 by a given clearance.

It should be noted that each second vane 153 is an example of the configuration of the second guide vane of the present invention.

The diffuser plate 154 is an annular component provided at the hub side of the diffuser part 116, and is the path wall part which forms the diffuser path along with the shroud side wall part 17 of the compressor housing 12. The second vanes 153 are provided on the diffuser plate 154. The second vanes 153 are provided so as to form an annular line on the right face side of the diffuser plate 154. Although in the present embodiment, the second vanes 153 are integrally formed with the diffuser plate 154, the second vanes 153 may employ pivot mechanisms, so that the angles of the second vanes 153 can be changed. The diffuser plate 154 is provided so as to be able to rotate coaxially with the rotating shaft of the impeller 13. The diffuser plate 154 rotationally moves coaxially with the rotating shaft of the impeller 13, so that the relative positions between the first vanes 52 and the second vanes 153 are changed.

Also, the diffuser plate 154 has the rack gear part 154*a* on an end face (i.e., an upper end face) of a side opposite to the impeller 13. The rack gear part 154*a* engages with the pinion gear 154*b* coupled with an actuator, not shown. In addition, the diffuser plate 154 has the guide rail part 154*c* on an end face of a side of the impeller 13.

The above-mentioned rotary mechanism operates according to the rotation of the pinion gear 154*b*, as described later. When the actuator operates the pinion gear 154*b*, the torque is sent to the diffuser plate 154 through the rack gear part 154*a*, and the diffuser plate 154 rotationally moves along the guide rail part 154*c*. When the diffuser plate 154 is rotationally moved coaxially with the rotating shaft of the impeller 13 by a given angle θ, a phase in a rotation direction of the second vanes 153 provided on the diffuser plate 154 is also changed by the angle θ. Thereby, the relative positions between the first vanes 52 and the second vanes 153 are changed.

By the rotary vane mechanism 150 described above, the second vanes 153 are rotationally moved to a position where the end faces thereof are opposed to the end faces of the first vane 52. Thereby, the first vanes 52 are opposed to the second vanes 153 in the diffuser path, and the compression efficiency of the compressor 111 can be improved. Moreover, each of the first vanes 52 and the second vanes 153 is projected to the substantial center of the width of the diffuser path. Since the ends of the first vanes 52 and the second vanes 153 are set to the vicinity of the center of the diffuser path (i.e., the vicinity of the half of the width of the diffuser path), the accumulation of the deposit to the ends of the vanes can be reduced.

In addition, by the rotary vane mechanism 150 described above, the second vanes 153 are rotationally moved to a position where the end faces thereof are not opposed to the end faces of the first vane 52. Thereby, a space located at an opposite side of each vane becomes vaneless, so that the air current can flow through the space and the same effect as expansion of a throat area is obtained. Therefore, the compressor efficiency of a range in which the volume of the air which flows through the compressor 111 is equal to or more than a given value can be maintained.

Figure 11A:
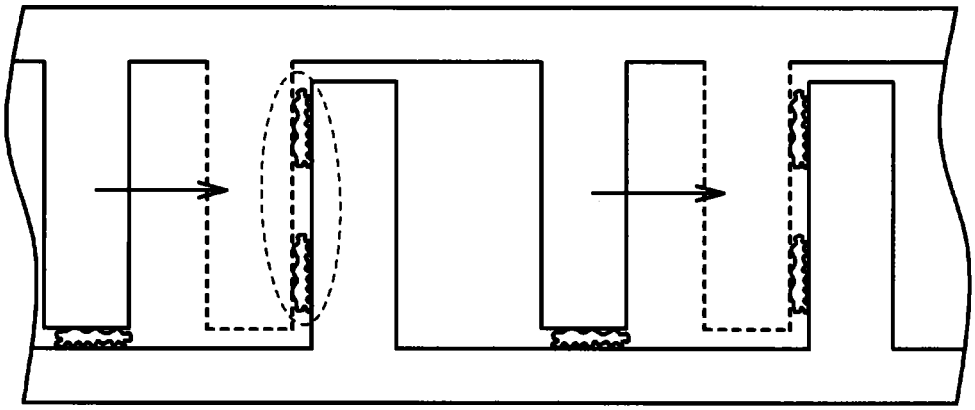
FIG. 11A is an explanatory diagram schematically illustrating rotational movement of the vanes of the compressor according to the comparative example.
Figure 11B:
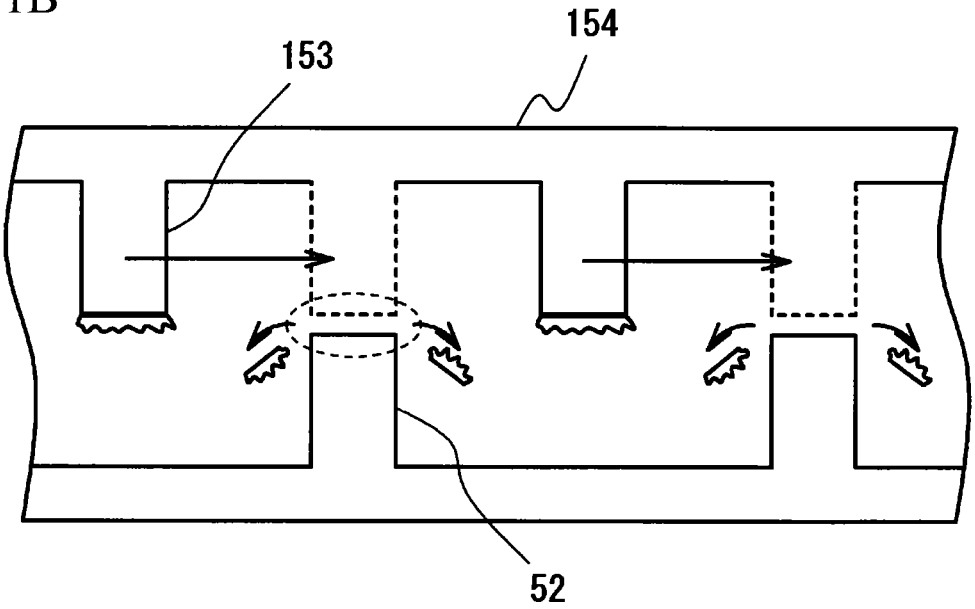
FIG. 11B is an explanatory diagram schematically illustrating rotational movement of the second vanes of the compressor according to the embodiment.

Moreover, when the second vanes 153 are rotationally moved by the rotary vane mechanism 150 described above, the deposit on the clearances can be scraped off by a shearing force. FIG. 11A is an explanatory diagram schematically illustrating the rotational movement of the vanes of the compressor according to the comparative example. FIG. 11B is an explanatory diagram schematically illustrating the rotational movement of the second vanes 153 of the compressor 111 according to the embodiment. When the clearances around the vanes are provided on the wall side of the diffuser path, the deposit which has occurred in the clearances is scraped up between the vanes (FIG. 11A). Therefore, it becomes difficult to secure the smooth operation of the vanes.

On the other hand, in the compressor 111 according to the present embodiment, the positions of the clearances generated when the first vanes 52 and the second vanes 153 are opposed to each other become the vicinity of the center of the diffuser path (i.e., the vicinity of the half of the width of the diffuser path). Therefore, the second vanes 153 are rotationally moved, so that the deposit which has occurred in the clearances between the first vanes 52 and the second vanes 153 can be scraped off (see FIG. 11B). Therefore, the accumulation of the deposit to the clearances can be reduced more effectively, and hence smooth operation of the vanes in the centrifugal compressor can be secured.

Figure 12:
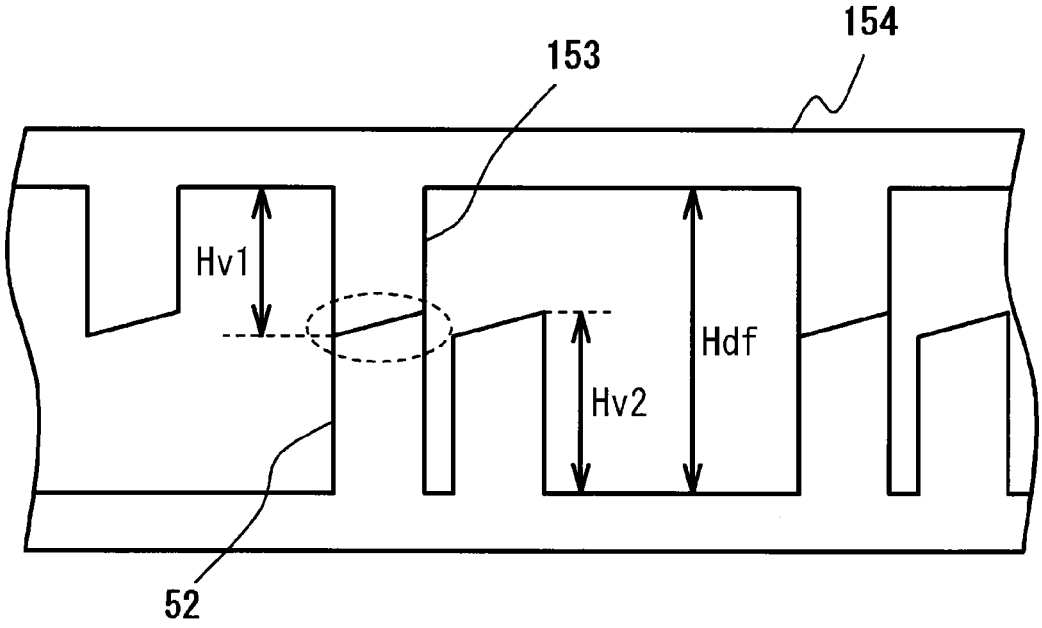
FIG. 12 illustrates an example of another configuration of first vanes and the second vanes according to the second embodiment.

In this case, when the second vanes 153 are rotationally moved by the rotary vane mechanism 150 to the position where the end faces thereof are opposed to the end faces of the first vanes 52, each other's end faces of the vanes may be engaged. FIG. 12 illustrates an example of another configuration of the first vanes 52 and the second vanes 153 according to the second embodiment. The end faces of the first vanes 52 have forms which have been inclined toward a direction where the opposite second vanes 153 are rotationally moved. Also, the end faces of the second vanes 153 have forms which engage with (or fit together with) the end faces of the first vanes 52. A sum (HV1+HV2) of a projection amount of maximum projection parts of the first vanes 52 and a projection amount of maximum projection parts of the second vanes 153 is configured to be larger than the width (Hdf) of the diffuser path. With this configuration, the second vanes 153 are rotationally moved by rotary vane mechanism 150 to the position where the end faces thereof are opposed to the end faces of the first vanes 52, so that the end faces of the first vanes 52 and the end faces of the second vanes 153 are engaged. Therefore, the clearances between the vanes can be vanished, and hence the loss by the air leak from the clearances between the end faces of the vanes vanishes away, thereby improving the compressor efficiency.

Figure 13A:
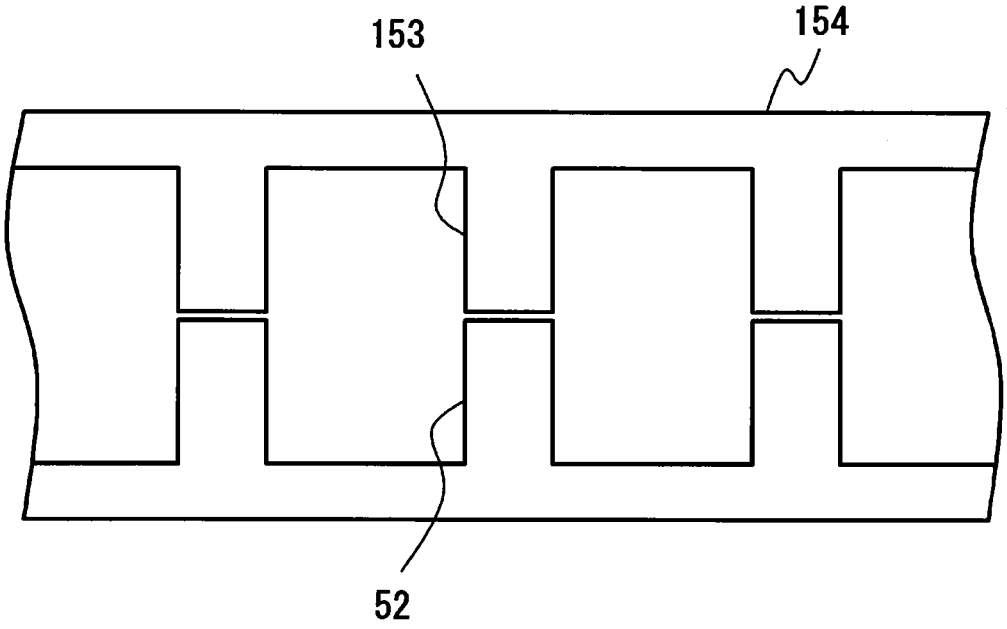
FIG. 13A is an explanatory diagram schematically illustrating the arrangement of the vanes when a compressor according to the second embodiment is in the low load range.
Figure 13B:
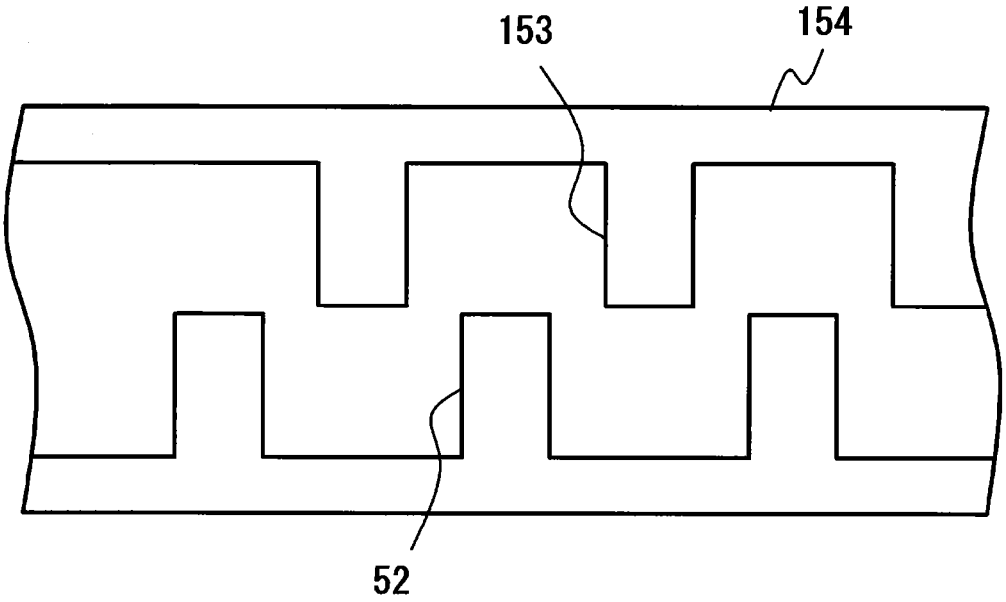
FIG. 13B is an explanatory diagram schematically illustrating the arrangement of the vanes when the compressor according to the second embodiment is in a high load range.

Next, a description will be given of the operation control of the rotary vane mechanism 150 according to the second embodiment. FIG. 13A is an explanatory diagram schematically illustrating the arrangement of the vanes when the compressor 111 according to the second embodiment is in the low load range. FIG. 13B is an explanatory diagram schematically illustrating the arrangement of the vanes when the compressor 111 according to the second embodiment is in the high load range. As with the first embodiment, the ECU (Electronic Control Unit) provided outside controls the actuator, for example, so that the operation control of the rotary vane mechanism 150 is performed. When the operating range of the compressor 111 is relatively the low load, i.e., a volume of the air which flows through the compressor 111 is less than a given value, the ECU requires the actuator to rotationally move the second vanes 153 to the position opposite to the first vanes 52 (see FIG. 13A). Thereby, the first vanes 52 and the second vanes 153 are opposed to each other in the diffuser path, so that the compression efficiency in the low load range of the compressor 111 can be improved. Here, the given value about the volume of the air and the detection method of the volume of the air are described above, and hence detailed description thereof is omitted.

On the other hand, when the operating range of the compressor 111 is relatively the high load, i.e., a volume of the air which flows through the compressor 111 is equal to or more than the given value, the ECU requires the actuator to rotationally move the second vanes 153 to a substantial intermediate position between the adjacent first vanes 52 (see FIG. 13B). Thereby, the relative positions between the first vanes 52 and the second vanes 153 are changed, so that the collision loss of the air to the first vanes 52 and the second vanes 153 is reduced. That is, stable operation in the high load range of the compressor 111 can be achieved. Moreover, the ends of the first vanes 52 and the second vanes 153 are located at the vicinity of the center of the diffuser path where the velocity of the fluid is relatively high, so that the accumulation of the deposit to the ends of the vanes can be reduced.

It should be noted that the rotary vane mechanism 150 is an example of the configuration of a rotation portion (i.e., the changeable portion) of the present invention.

As described above, the compressor according to the present embodiment includes the rotary vane mechanism that can rotate the diffuser plate having the second vanes coaxially with a rotating shaft of the impeller, so that the relative positions between the first vanes and the second vanes can be changed. That is, the sizes of the clearances between the first vanes and the second vanes can be changed. The ends of the first vanes and the second vanes are located at the vicinity of the center of the diffuser path where the velocity of the fluid is relatively high, so that the deposit on the ends of the vanes can be scraped off by the shearing force. Therefore, the accumulation of the deposit to the clearances can be reduced more appropriately.

Here, although the compressor 111 according to the present embodiment is configured to include the rotary vane mechanism 150 in the hub side, the compressor 111 may be configured to include the rotary vane mechanism 150 in the shroud side. Thereby, the layout characteristic of the compressor 111 can be improved.

Third Embodiment

Next, a description will be given of a third embodiment of the present invention. A compressor 211 according to the third embodiment differs from that of the first embodiment in that a diffuser plate 254 having a plurality of first vanes 252 includes a slide vane mechanism 250 that can move along a shaft direction of the compressor 211, in the shroud side.

Figure 14:
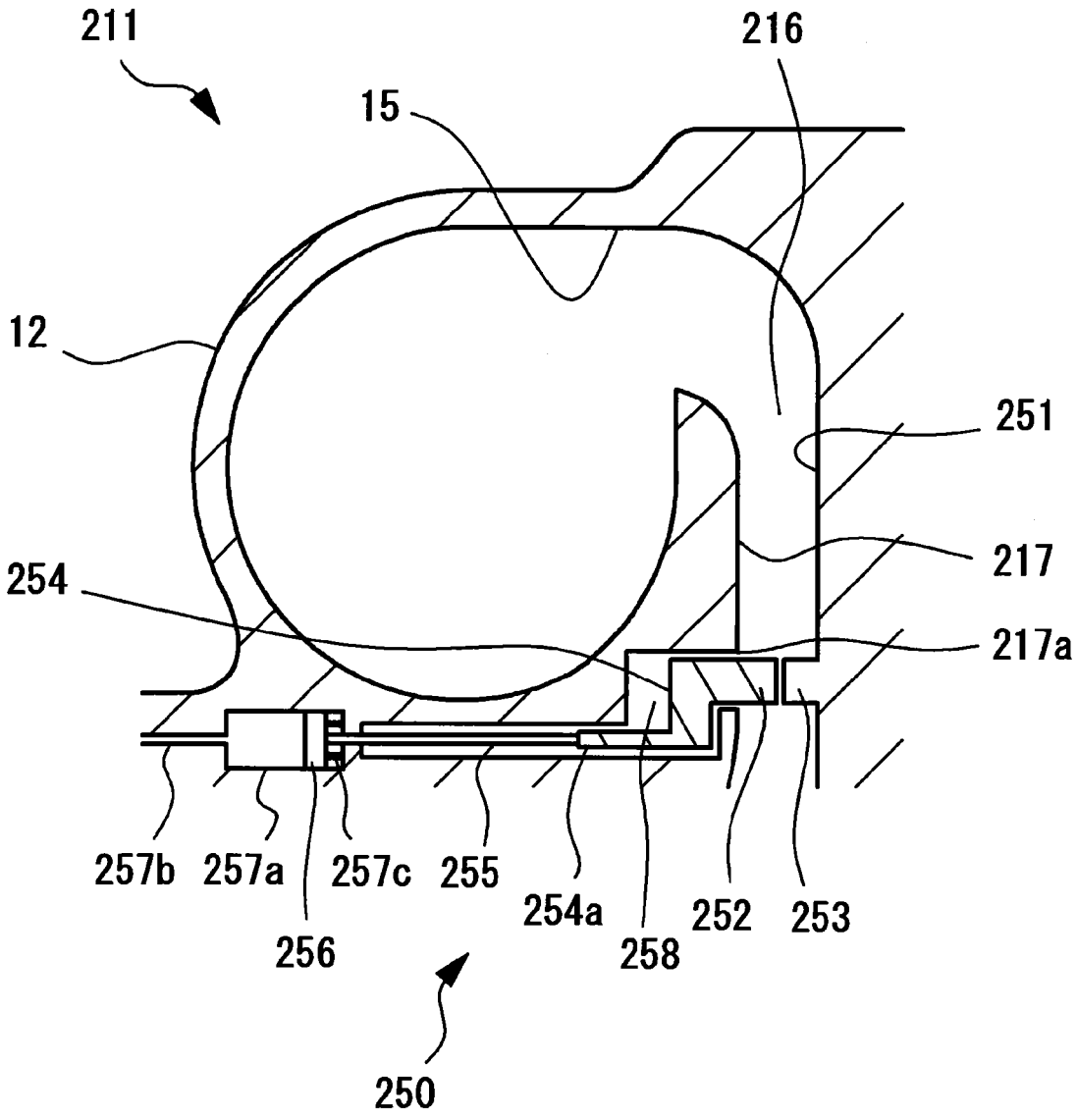
FIG. 14 is a cross-section diagram illustrating the substantial part of the diffuser part according to a third embodiment.

FIG. 14 is a cross-section diagram illustrating the substantial part of a diffuser part 216 according to the third embodiment. FIG. 14 illustrates a cross-section surface taken along a width direction of the first vanes 252. The diffuser part 216 includes a shroud side part plate 217 on which slits 217*a* are provided, and a hub side wall part 251 on which second vanes 253 are provided. In addition, the diffuser part 216 includes a slide vane mechanism 250 that can project the first vanes 252 into the diffuser path via the slits 217*a*, and draw in the first vanes 252 from the diffuser path via the slits 217*a*. It should be noted that corresponding component elements to those in the first embodiment are designated by the same numerals in drawings.

The slide vane mechanism 250 is attached to the compressor housing 12 from a side of the front face of the impeller 13. The slide vane mechanism 250 includes: the first vanes 252 integrated with the diffuser plate 254; the diffuser plate 254 having an extending part 254*a*; a piston rod 255 having both ends coupled with the extending part 254*a* and a piston 256, respectively; a hydraulic cylinder 257; and a housing part 258.

As illustrated in FIG. 14, the compressor 211 includes movable first vanes 252 and fixed second vanes 253. The second vanes 253 are guide vanes provided on the hub side wall part 251, and are provided so as to form an annular line to the diffuser path. Then, each end face of the second vanes 253 projects to the substantial center of the width of the diffuser path. Since another configuration of the second vanes 253 is the same as that of the first and the second embodiments, a description thereof is omitted.

It should be noted that each second vane 253 is an example of the configuration of the second guide vane of the present invention.

The first vanes 252 are guide vanes provided on the diffuser plate 254 at the shroud side, and are provided at positions opposed to the second vanes 253 (for every second vanes 253), respectively. The first vanes 252 can project into and draw in from the diffuser path through the slits 217*a* of the shroud side wall part plate 217. Since another configuration of the first vanes 252 is the same as that of the first and the second embodiments, a description thereof is omitted.

It should be noted that each first vane 252 is an example of the configuration of the first guide vane of the present invention.

The shroud side wall part plate 217 is a path wall part which forms the diffuser path along with the hub side wall part 251 of the compressor housing 12. The shroud side wall part plate 217 has the slits 217*a*. The slits 217*a* are through holes having similar shapes to the first vanes 252. The slits 217*a* are provided at positions opposed to the second vanes 253 for every first vanes 252, and enable the first vanes 252 to project into the diffuser path. It should be noted that each slit 217*a* is an example of the configuration of a first through hole of the present invention.

The diffuser plate 254 is provided behind the shroud side wall part plate 217. The diffuser plate 254 is an annular component, and the first vanes 252 are provided on the diffuser plate 254. The first vanes 252 are provided so as to form an annular line on the right face side of the diffuser plate 254.

Although in the present embodiment, the first vanes 252 are integrally formed with the diffuser plate 254, the angles of the vanes may be changed. The diffuser plate 254 is provided so as to be able to move along a shaft direction of the compressor 211. The diffuser plate 254 moves along the shaft direction of the compressor 211, so that the first vanes 252 are projected into or drawn in from the diffuser path.

The diffuser plate 254 includes the extending part 254*a* on the rear of the diffuser plate 254 which is an opposite side of the diffuser path. An end of the extending part 254*a* is coupled with the piston rod 255. A piston 256 slidably housed in the hydraulic cylinder 257 is coupled with another end of the piston rod 255. The hydraulic cylinder 257 is mainly composed of a cylinder body 257*a*, a hydraulic introduction port 257*b*, and a spring 257*c*.

The above-mentioned hydraulic mechanism operates according to the supply of a hydraulic pressure, as described later. That is, when the hydraulic pressure which exceeds a bias force of the spring 257*c* is supplied from the hydraulic introduction port 257*b*, the piston 256 moves to the side of the diffuser path inside the cylinder body 257*a* by the hydraulic pressure. When the piston 256 moves to the side of the diffuser path, the diffuser plate 254 that is coupled with the piston 256 via the piston rod 255 and the extending part 254*a* also moves to the side of the diffuser path. Thereby, the first vanes 252 provided on the diffuser plate 254 are projected from the slits 217*a*. On the other hand, when the hydraulic pressure supplied from the hydraulic introduction port 257*b* does not exceed the bias force of the spring 257*c*, the piston 256 moves to a side opposite to the diffuser path inside the cylinder body 257*a* by the bias force of the spring 257*c*. When the piston 256 moves to the side opposite to the diffuser path, the first vanes 252 coupled with the piston rod 255, the extending part 254*a* and the diffuser plate 254 are buried (drawn) into the slits 217*a*. Thus, the hydraulic mechanism projects the first vanes 252 into the diffuser path and draws in the first vanes 252 from the diffuser path.

The housing part 258 is a hollow room formed with the compressor housing 12 and the shroud side wall part plate 217. The housing part 258 has an enough space that can house the whole first vanes 252, and houses the first vanes 252 to be buried (drawn) into the slits 217*a* according to the operation of the hydraulic cylinder 257.

By the above-mentioned slide vane mechanism 250, each end face of the first vanes 252 is projected to the substantial center of the width of the diffuser path and to a position in which each end face of the first vanes 252 does not contact each end face of the opposed second vanes 253. That is, each first vane 252 is projected to a position away from a corresponding end face of the opposed second vanes 253 by a given clearance. Thereby, the first vanes 252 and the second vanes 253 are projected into the diffuser path, so that the compression efficiency of the compressor 211 can be improved. Moreover, the position at which the clearance between each first vane 252 and each second vane 253 is provided can be set in the vicinity of the center of the diffuser path (in the vicinity of the half of the width of the diffuser path).

Further, by the above-mentioned slide vane mechanism 250, the first vanes 252 are buried (drawn) into the slits 217*a*. Thereby, the clearance between each first vane 252 and each second vane 253 can be enlarged, and hence collision loss of the air to the first vanes 252 and the second vanes 253 can be reduced. Moreover, the wall surface of the diffuser path at the side in which the first vanes 252 are drawn becomes vaneless, and is in a state where a definite throat is not formed.

In this case, as a form in which the end faces of the first vanes 252 engage with (or fit together with) the end faces of the second vanes 253 as with the first embodiment, the end faces of the first vanes 252 may be projected to the positions where they come in contact with the end faces of the opposed second vanes 253, by the use of the slide vane mechanism 250. Since the operation control of the above-mentioned slide vane mechanism 250 is the same as that of the first embodiment, a description thereof is omitted.

It should be noted that the slide vane mechanism 250 is an example of the configuration of the projection and drawing portion (i.e., the changeable portion) of the present invention.

As described above, the compressor according to the present embodiment can project the first vanes into the diffuser path via the slits of the shroud side wall part plate and draw in the first vanes from the diffuser path via the slits of the shroud side wall part plate. Thereby, when the first vanes are going to be buried, the clearances between the first vanes and the second vanes can be located at the vicinity of the center of the diffuser path where the velocity of the fluid is relatively high. Therefore, the accumulation of the deposit to the ends of the vanes can be reduced more effectively. In addition, the first vanes are projected into and drawn in from the diffuser path according to the load of the compressor, so that high compression efficiency can be obtained in all load range of the compressor.

The above-mentioned embodiments are merely examples carrying out the present invention. Therefore, the present invention is not limited to those, and various modification and change could be made hereto without departing from the spirit and scope of the claimed present invention.

For example, the rotating shaft of the rotary movement by the rotary vane mechanism is not limited to the same shaft as the rotating shaft of the impeller 13, and may be decentered from the rotating shaft of the impeller 13 and rotationally move the diffuser plate.

Further, the positions where the first vanes are opposed to the second vanes in the diffuser path are not limited to the vicinity of the center of the diffuser path, and may be shifted to the shroud side or the hub side of the diffuser path.

DESCRIPTION OF LETTERS OR NUMERALS

11, 111, 211 . . . compressor
16, 116, 216 . . . diffuser part
50, 150, 250 . . . vane mechanism
51*a*, 217*a* . . . slit
52, 252 . . . first vane
53, 153, 253 . . . second vane
54, 154, 254 . . . diffuser plate

The invention claimed is:

1. A centrifugal compressor comprising:

a diffuser path that converts kinetic energy of a fluid which an impeller discharges into a pressure, the impeller rotating in a housing of the compressor;

a shroud side wall part that forms the diffuser path;

a hub side wall part that is opposed to the shroud side wall part, and forms the diffuser path along with the shroud side wall part;

a first guide vane that is provided on the shroud side wall part, and projects into the diffuser path toward the hub side wall part;

a second guide vane that is provided on a position on the hub side wall part opposed to the first guide vane, and projects into the diffuser path toward the first guide vane; and a changeable portion capable of changing a relative position between the first guide vane and the second guide vane;

wherein an end face of the first guide vane facing toward the hub side wall part and an end face of the second guide vane facing toward the shroud side wall part are opposed to each other in the diffuser path, and the changeable portion is a rotation portion that rotates at least one of the first guide vane and the second guide vane in a circumferential direction of the impeller, and the changeable portion changes the relative position between the first guide vane and the second guide vane according to a pressure of the fluid which flows through the compressor.

2. A centrifugal compressor comprising:

a diffuser path that converts kinetic energy of a fluid which an impeller discharges into a pressure, the impeller rotating in a housing of the compressor;

a shroud side wall part that forms the diffuser path;

a hub side wall part that is opposed to the shroud side wall part, and forms the diffuser path along with the shroud side wall part;

a first guide vane that is provided on the shroud side wall part, and projects into the diffuser path toward the hub side wall part;

a second guide vane that is provided on a position on the hub side wall part opposed to the first guide vane, and projects into the diffuser path toward the first guide vane; and a changeable portion capable of changing a relative position between the first guide vane and the second guide vane;

wherein an end face of the first guide vane and an end face of the second guide vane are opposed to each other in the diffuser path, the changeable portion is a rotation portion that rotates at least one of the first guide vane and the second guide vane in a circumferential direction of the impeller, and the changeable portion changes the relative position between the first guide vane and the second guide vane according to a pressure of the fluid which flows through the compressor;

the first guide vane and the second guide vane have parts in which amounts of projection into the diffuser path are different, respectively, a sum of a maximum amount of projection of the first guide vane and a maximum amount of projection of the second guide vane is equal to or more than a width of the diffuser path, and the end face of the first guide vane and the end face of the second guide vane have forms which engage with each other.

* * * * *